US008044349B2

(12) United States Patent
Satake et al.

(10) Patent No.: US 8,044,349 B2
(45) Date of Patent: Oct. 25, 2011

(54) MASS SPECTROMETER

(75) Inventors: Hiroyuki Satake, Kokubunji (JP); Yuichiro Hashimoto, Tachikawa (JP); Yasuaki Takada, Kiyose (JP)

(73) Assignee: Hitachi High-Technologies Corporation, Tokyo (JP)

( * ) Notice: Subject to any disclaimer, the term of this patent is extended or adjusted under 35 U.S.C. 154(b) by 405 days.

(21) Appl. No.: 12/173,328

(22) Filed: Jul. 15, 2008

(65) Prior Publication Data

US 2009/0020695 A1 Jan. 22, 2009

(30) Foreign Application Priority Data

Jul. 17, 2007 (JP) ..... 2007-185214

(51) Int. Cl.
*H01J 49/00* (2006.01)

(52) U.S. Cl. ..... 250/290; 250/293; 250/299

(58) Field of Classification Search ..... 250/281, 250/282, 287, 288, 290, 292, 293, 299
See application file for complete search history.

(56) References Cited

U.S. PATENT DOCUMENTS

| | | | | |
|---|---|---|---|---|
| 5,847,386 | A | 12/1998 | Thomson et al. | |
| 6,687,166 | B1 * | 2/2004 | Takahashi et al. | 365/189.05 |
| 6,933,750 | B2 * | 8/2005 | Takahashi et al. | 326/82 |
| 6,967,323 | B2 * | 11/2005 | Hashimoto et al. | 250/281 |
| 7,064,319 | B2 | 6/2006 | Hashimoto et al. | |
| 7,071,464 | B2 * | 7/2006 | Reinhold | 250/282 |
| 7,129,478 | B2 * | 10/2006 | Baba et al. | 250/281 |
| 7,227,137 | B2 * | 6/2007 | Londry et al. | 250/292 |
| 7,397,025 | B2 * | 7/2008 | Baba et al. | 250/281 |
| 7,633,060 | B2 * | 12/2009 | Kovtoun | 250/292 |
| 2003/0066958 | A1 * | 4/2003 | Okumura et al. | 250/286 |
| 2003/0189171 | A1 * | 10/2003 | Londry et al. | 250/292 |
| 2004/0012412 | A1 * | 1/2004 | Takahashi et al. | 326/86 |
| 2004/0013021 | A1 * | 1/2004 | Takahashi et al. | 365/203 |
| 2004/0238734 | A1 * | 12/2004 | Hager et al. | 250/281 |
| 2004/0245455 | A1 * | 12/2004 | Reinhold | 250/288 |
| 2005/0023452 | A1 * | 2/2005 | Hashimoto et al. | 250/281 |
| 2005/0178963 | A1 * | 8/2005 | Londry et al. | 250/293 |
| 2008/0265155 | A1 * | 10/2008 | Kovtoun | 250/292 |
| 2010/0188789 | A1 * | 7/2010 | Satake et al. | 361/90 |

FOREIGN PATENT DOCUMENTS

JP 2005-44594 2/2005

* cited by examiner

*Primary Examiner* — Bernard E Souw
(74) *Attorney, Agent, or Firm* — Mattingly & Malur, PC

(57) ABSTRACT

A mass spectrometer includes a linear multipole electrode, an auxiliary electrode that applies a DC potential on the center axis of the linear multipole electrode, and a DC power supply that supplies a DC power to the auxiliary electrode. The DC potential slope formed on the center axis of the multipole electrode is changed according to the measuring condition. The ejection time of ions can be adjusted optimally by adjusting the potential slope so as to satisfy the measuring condition. If the ejection time of ions is shortened, confusion of different ion information items that might otherwise occur on a spectrum can be avoided. If the ejection time of ions is lengthened, detection limit exceeding can be avoided and ions can be measured efficiently, thereby highly efficient ion measurements are always assured.

23 Claims, 13 Drawing Sheets

MASS SPECTROMETER

CLAIM OF PRIORITY

The present application claims priority from Japanese patent application JP 2007-185214 filed on Jul. 17, 2007, the content of which is hereby incorporated by reference into this application.

FIELD OF THE INVENTION

The present invention relates to a mass spectrometer.

BACKGROUND OF THE INVENTION

In case of a mass spectrometry, sample molecules are ionized and introduced into a vacuum chamber or ionized in the vacuum chamber, then the ion movement in an electromagnetic field is measured, thereby measuring the mass charge ratio m/z (m: mass, z: the number of charges) of the object molecular ions. In this case, because what is obtained is a mass-to-charge ratio (m/z), it is difficult to obtain the internal structure information of the object molecular ions, as well. This is why a so-called tandem mass spectrometry is often used. This tandem mass spectrometry carries out the first mass spectrometric operation to identify or select sample molecular ions. These ions are referred to as precursor ions. Then, the tandem mass spectrometry carries out the second mass spectrometric operation to dissociate those precursor ions with use of a method. The dissociated ions are referred to as fragment ions. These fragment ions are further subjected to a mass spectrometric process to obtain a fragment ions generation pattern. The use of this dissociation pattern makes it possible to estimate the arrangement structure of the precursor ions. The tandem mass spectrometry is widely employed for such mass spectrometers as the ion trap, ion trap time-of-flight, triple quadrupole, and quadrupole time-of-flight ones. Particularly, the ion trap and ion trap time-of-flight spectrometers can carry out plural tandem mass spectrometric operations, thereby enabling efficient structure analysis of ions.

There is still another quadrupole ion trap mass spectrometer employable for mass spectrometry capable of tandem mass analysis. As such a quadrupole ion trap, there are Paul trap consisting of a ring electrode and a pair of end cap electrodes, and a quadrupole linear ion trap consisting of 4 cylindrical electrodes. If a radio frequency voltage of 1 MHz or so is applied to a ring electrode or cylindrical electrode, ions that are over a certain mass level come to be stabilized in a quadrupole ion trap, thereby ions can be accumulated therein.

Each of the triple quadrupole and quadrupole time-of-flight mass spectrometers is provided with a quadrupole mass filter in the preceding stage of its ion dissociation device. The quadrupole mass filter passes only ions having a specific mass-to-charge ratio (m/z) and excludes other ions. The quadrupole mass filter can also scan the mass-to-charge ratio (m/z) of the passing ions, thereby identifying and selecting object ions.

U.S. Pat. No. 5,847,386 discloses a method of how to shorten the ejection time of ions in a triple quadrupole mass spectrometer and a quadrupole time-of-flight mass spectrometer respectively. According to the method, a multipole rod electrode disposed in an ion dissociation device is inclined or an inclined electrode is inserted between multipole rod electrodes to generate a DC electric field on the center axis of the multipole electrode in the exit direction, thereby shortening the ejection time of ions.

JP-A-2005-044594 describes a collisional-damping chamber formed by introducing such an He gas, etc. into a quadrupole electrode so as to connect an ion trap to a time-of-flight mass spectrometer. This spectrometer enables ion measurements in a wider dynamic range of mass-to-charge ratio (m/z), thereby realizing tandem mass analysis at high sensitivity and at high precision.

SUMMARY OF THE INVENTION

Ions are ejected like pulses from an ion trap in a very short time, so that a time-of-flight mass spectrometer cannot measure those ions efficiently. In order to solve such a problem, JP-A-2005-044594 describes a method that uses a collisional-damping chamber to lengthen the time distribution of ions that have been ejected massively from an ion trap in a short time; thereby, it is enabled to send those ions continuously into a time-of-flight mass spectrometer. As a result, ions come to be measured very efficiently. According to the technique described in JP-A-2005-044594, however, it is still insufficient to improve the utilization efficiency of ions. Even among ions ejected from an ion trap and having the same mass-to-charge ratio (m/z), some ions have a short ejection time and others have a long ejection time. Thus it is not so easy to control the ejection time of ions properly. This has been a problem conventionally. And when changing the ejection time of ions, it is also required to change the amount of the bath gas to be introduced and adjust the voltage of each electrode. And in this case, the sensitivity and the resolution of measurements might be lowered. This has also been a problem conventionally.

Furthermore, the ejection time of ions might also change if the DC potential on the center axis of the quadrupole electrode is disturbed by any of such troubles as those caused by the geometrical shape and assembling error of the electrode used in a collisional-damping chamber or the like, as well as any of such troubles as those caused by a difference from the ideal value of a radio frequency voltage applied to the quadrupole electrode, sample ions, etc. stuck on the quadrupole electrode and end lens electrode, etc.

If the ejection time of ions is long or short in a collisional-damping chamber, the following problems might also arise.

If ions are stayed in the subject collisional-damping chamber and not ejected so easily, that is, if the ejection time of ions or staying time is long, ions that have different information items and therefore should not be mixed come to be mixed in the collisional-damping chamber. In other words, the information of many ions are mixed in a spectrum. This is a problem.

Furthermore, if ions are ejected immediately from the subject collisional-damping chamber, that is, if the ejection time of ions or staying time is short, the ions utilization efficiency in the mass analyzer comes to be lowered and accordingly, the dynamic range of ions intensity comes to be lowered. This is a problem. And the amount of ions accumulated in an ion trap is fixed regardless of the ejection time. Therefore, if the ejection time is short and ions are ejected massively like pulses in a short time, the amount of ions to be ejected per unit time increases, thereby a problem (detector saturation) occur. In other words, all the object ions are not detected by the detector of the mass analyzer provided in the succeeding stage. For example, in case of a time-of-flight mass spectrometer, the problem often occurs if a time-to-digital converter (TDC) is used. The TDC detects a signal received from a detector such as a micro channel plate (MCP) and checks if the signal exceeds a threshold value or not. Thus the TDC outputs "1" regardless of the number of ions incident simultaneously.

Consequently, in case of a high concentration sample, an ion intensity is saturated and accordingly the quantitative property is lost. In other words, the dynamic range of ions intensity is lowered. The similar problem also occurs in the analog-to-digital converter (ADC).

U.S. Pat. No. 5,847,386 describes a method that shortens the ejection time of ions. If the preceding stage is disposed a quadrupole filter or an ion guide, ions are introduced into them. If the ejection time of ions is long, ions having different information items come to be mixed with each other. In order to avoid this problem, therefore, the ions ejection time should be shortened.

Under such circumstances, it is an object of the present invention to control both ions having a short ejection time and ions having a long ejection time that co-exist. In other words, the object of the present invention is to lengthen the ejection time of ions ejected like pulses in a short time so as not to exceed the detection limit in a specific case where an ion trap and a matrix-assisted laser desorption ion source are disposed in the preceding stage and to shorten the ejection time of ions to be ejected in a long time and accordingly to be often left over in the next measuring sequence. It is another object of the present invention to properly control the ejection time of ions shorter or longer according to the measuring and environmental conditions.

As described above, any conventional techniques have been difficult to adjust such ejection times of ions to be ejected shorter and longer from a collisional-damping chamber optimally and simultaneously in accordance with the measuring condition.

DETAILED DESCRIPTION OF THE PREFERRED EMBODIMENTS

Figure 1:
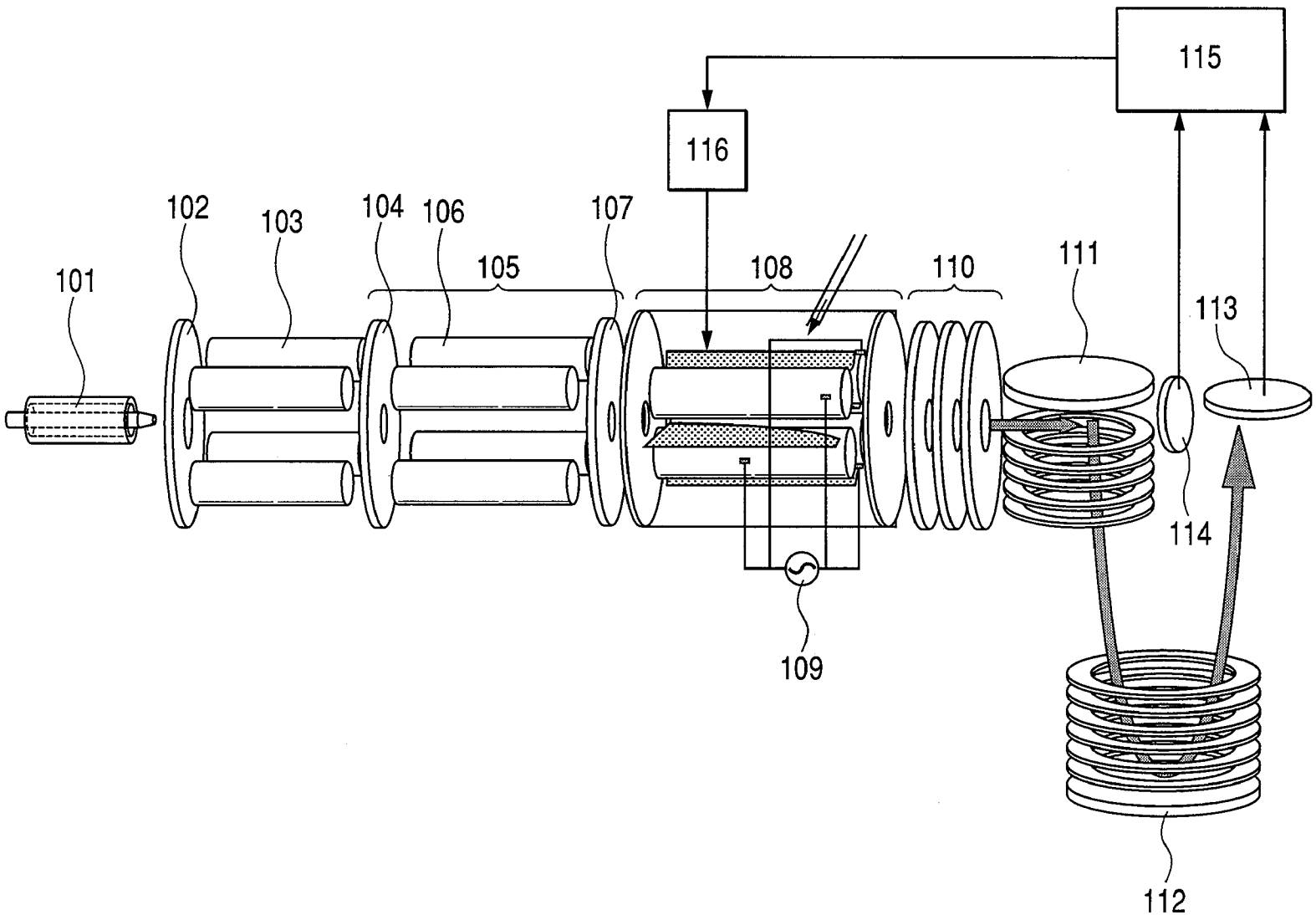
FIG. 1 is a diagram that describes an embodiment of a mass spectrometer that controls ejection time of ions with use of a collisional-damping chamber including linear quadrupole electrodes capable of applying a radio frequency voltage and auxiliary electrodes capable of applying a DC voltage in the space of linear quadrupole electrodes.

Hereunder, there will be described a mass spectrometer capable of adjusting ejection time of ions so as to be shortened and lengthened simultaneously, thereby ejecting ions as uniformly as possible (temporally) in a linear multipole electrode of such a device as a collisional-damping chamber. There will also be described an operating method thereof.

The mass spectrometer disclosed in this specification includes a linear multipole electrode, a device that forms a potential slope along the center axis of the linear multipole electrode, and a DC power supply that supplies a radio frequency voltage to those devices. The potential slope forming device applies the DC potential on the center axis of the linear multipole electrode and the formed potential slope is changed, so that the ejection or staying time of ions is controlled so as to be lengthened or shortened. This is why ions are ejected uniformly, temporally. The auxiliary electrode is configured so as to form a potential slope on the center axis of the multipole electrode. Thus if the DC voltage is applied to the auxiliary electrode, a DC potential having a slope is formed on the center axis of the multipole electrode, and the slope is changed, the speed of ions is controlled, thereby the ejection time of ions is controlled. Because the potential slope is changed in such way, ions are ejected uniformly (temporally).

Next, there will be described how to monitor the ejection time of ions and the amount of ions to be ejected from the multipole electrode, in case where the multipole electrode of such a device as a collisional-damping chamber and the ion trap in the preceding stage of the multipole electrode is disposed. At first, ions ejected just by once from the ion trap are introduced into the collisional-damping chamber. Hereinafter, no ion is introduced into the collisional-damping chamber from the ion trap until the monitoring is finished. The ions introduced into the collisional-damping chamber just by once are measured each time an amount of ions are ejected from the collisional-damping chamber. At this time, the amount of ions is measured each ejection time at intervals of 100 μsec to several msec. After an ions ejection time measurement is finished in this way, the voltage of the auxiliary electrode is changed, then the next amount of ions is measured each ejection time. This cycle of measurements is repeated. An optimal ejection time is determined when the ejection time becomes finally equal to or slightly shorter than the cycle of the ion trap disposed in the preceding stage and the optimal measuring condition is determined within the detection limit.

If the ejection time is judged long as a result of the monitoring, the DC potential is formed with a sharp downward slope on the center axis of the multipole electrode, thereby shortening the ejection time. In this case, ions are ejected from the collisional-damping chamber more quickly. If the ejection time is judged short as a result of the monitoring, the DC potential is formed with a gradual downward slope or very gradual upward slope on the center axis of the multipole electrode, thereby lengthening the ejection time. In this case, ions are ejected slowly from the collisional-damping chamber. This potential slope change is made in real time even while ions are ejected; thereby, it is possible to control the ejection time of ions properly.

It is still another object of the present invention disclosed in this specification to control the ejection or staying time of ions while the ejection or staying time is to be changed in accordance with the measuring and environmental conditions in a linear multipole electrode. Because the ion ejection time is adjusted in such a way, it is possible to avoid a conventional problem that different ion information items on a mass spectrum are mixed in case of a long ejection time of the ions. And it is also possible to avoid a loss of ions that are over a preset detection limit, which becomes a problem in the case of a short ejection time of ions. In case of the present invention, those problems can be avoided simultaneously, thereby highly efficient measurements are always assured.

First Embodiment

FIG. 1 illustrates an embodiment of a mass spectrometer that controls ejection time of ions as described above with use of a collisional-damping chamber 108 that includes plural linear quadrupole electrodes that can apply a radio frequency voltage respectively and plural auxiliary electrodes, each being disposed between the linear quadrupole electrodes and capable of applying a DC voltage. Although linear quadrupole electrodes are employed here, they may be replaced with any devices consisting of 4, 6, or 8 rod electrodes respectively and a radio frequency is applied to every other rod of those rod electrodes.

In FIG. 1, a quadrupole linear ion trap 105 is disposed in the preceding stage of the collisional-damping chamber 108 disclosed in this specification and the time-of-flight mass spectrometer 111-113 are disposed in the succeeding stage of the collisional-damping chamber 108. While a time-of-flight mass spectrometer is employed here, it may be replaced with any detector(s) capable of detecting ions ejected from a collisional-damping chamber respectively.

Next, there will be described the analyzing processes of the mass spectrometer in this first embodiment. An object sample to be analyzed by the mass spectrometer is separated from other components by a liquid chromatograph or the like, then ionized in an ion source 101. The ionized sample is passed through linear quadrupole ion guides 102 to 104 disposed in a vacuum chamber and introduced into a linear ion trap 105. The linear ion trap 105 is filled with helium and argon gases, etc. The sample ions collide with those gases and are cooled down, thereby becoming trapped therein. The linear ion trap 105 accumulates, separates, and ejects ions. The ejected ions are then introduced into a collisional-damping chamber 108 of the present invention. The collisional-damping chamber 108 is already filled with helium and argon gases, etc. The orbits of the ions charged into the collisional-damping chamber 108 are converged, so that those ions are ejected continuously. After this, the ions are measured of the mass-to-charge ratio (m/z) in the time-of-flight mass spectrometer 111 to 113. Furthermore, a data storage/controller 115 monitors the ejection time of ions to control a DC voltage supply 116 according to the monitoring result.

Figure 2:
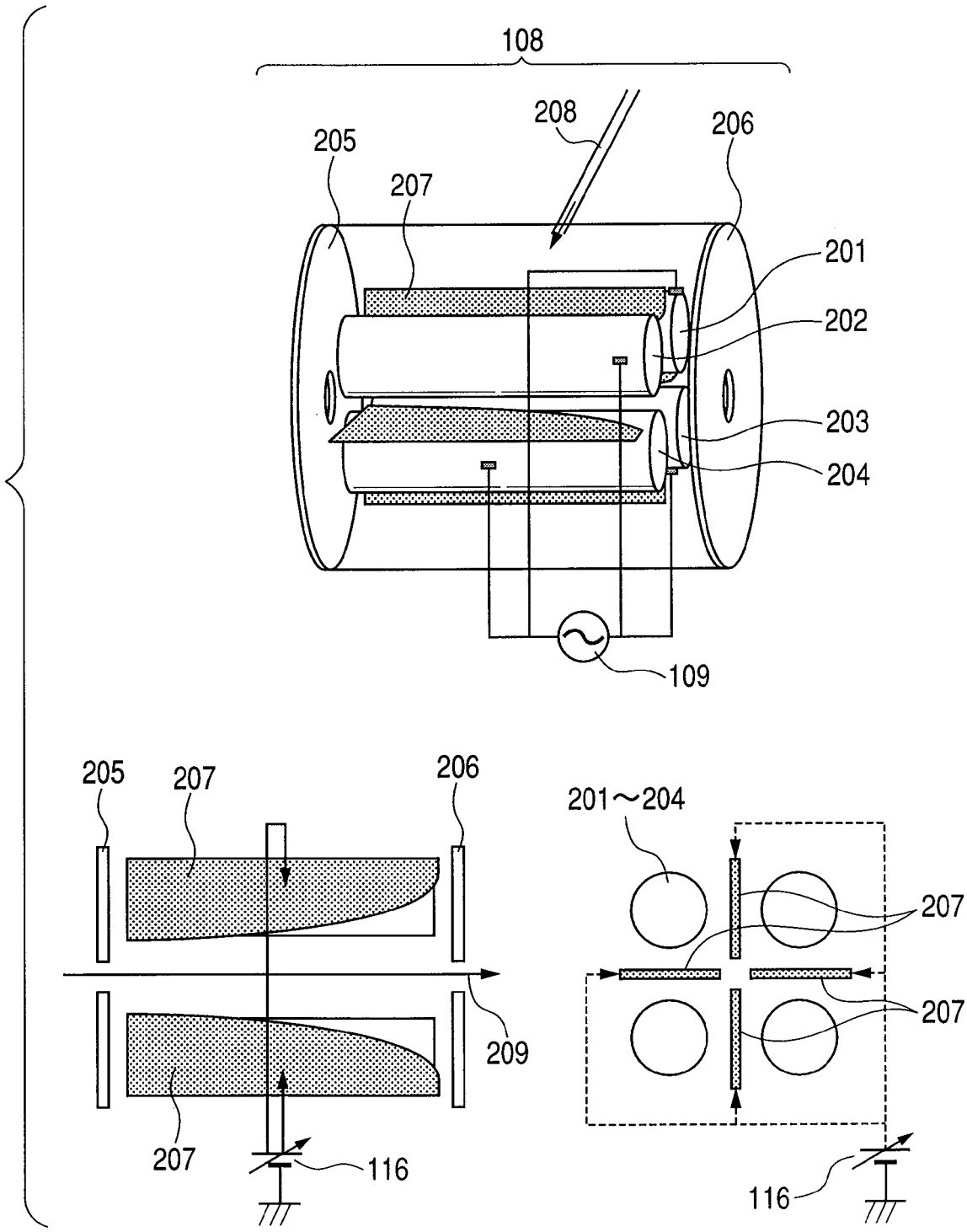
FIG. 2 is a detailed diagram of the collisional-damping chamber shown in FIG. 1.

FIG. 2 shows a detailed diagram of the collisional-damping chamber 108 shown in FIG. 1. In the upper half of FIG. 2 is shown an external view of the collisional-damping chamber and in the lower half of FIG. 2 is shown a cross sectional view of each part of the collisional-damping chamber 108. The collisional-damping chamber 108 includes linear quadrupole electrodes 201 to 204, end lens electrodes 205 to 206, a radio frequency voltage supply 109 used for the linear quadrupole electrodes 201 to 204, four curvilinear auxiliary electrodes 207, each being disposed between the linear quadrupole electrodes, a DC voltage supply used for the four auxiliary electrodes, and a gas inlet 208. The collisional-damping chamber 108 is filled intentionally with a helium gas, etc. to eject ions continuously, so that it is almost sealed except for the gas inlet 208 and the ion ports of the end lens electrodes 205 to 206. In this embodiment, only one DC voltage supply 116 is used for the four auxiliary electrodes and the same voltage is applied to those auxiliary electrodes.

The four auxiliary electrodes 207 and the DC voltage supply 116 used for those auxiliary electrodes are used to control the ejection time of ions ejected from the collisional-damping chamber 108. The DC voltage applied to those auxiliary electrodes 207 is changed to make the controlling. In this embodiment, there will be described a method for controlling such ejection times of ions. And the method will be applied to positive ions to be moved from the left side in FIG. 2 along the orbit denoted with an arrow 209. The same controlling is also possible for negative ions by inverting the voltage polarity.

Figure 3:
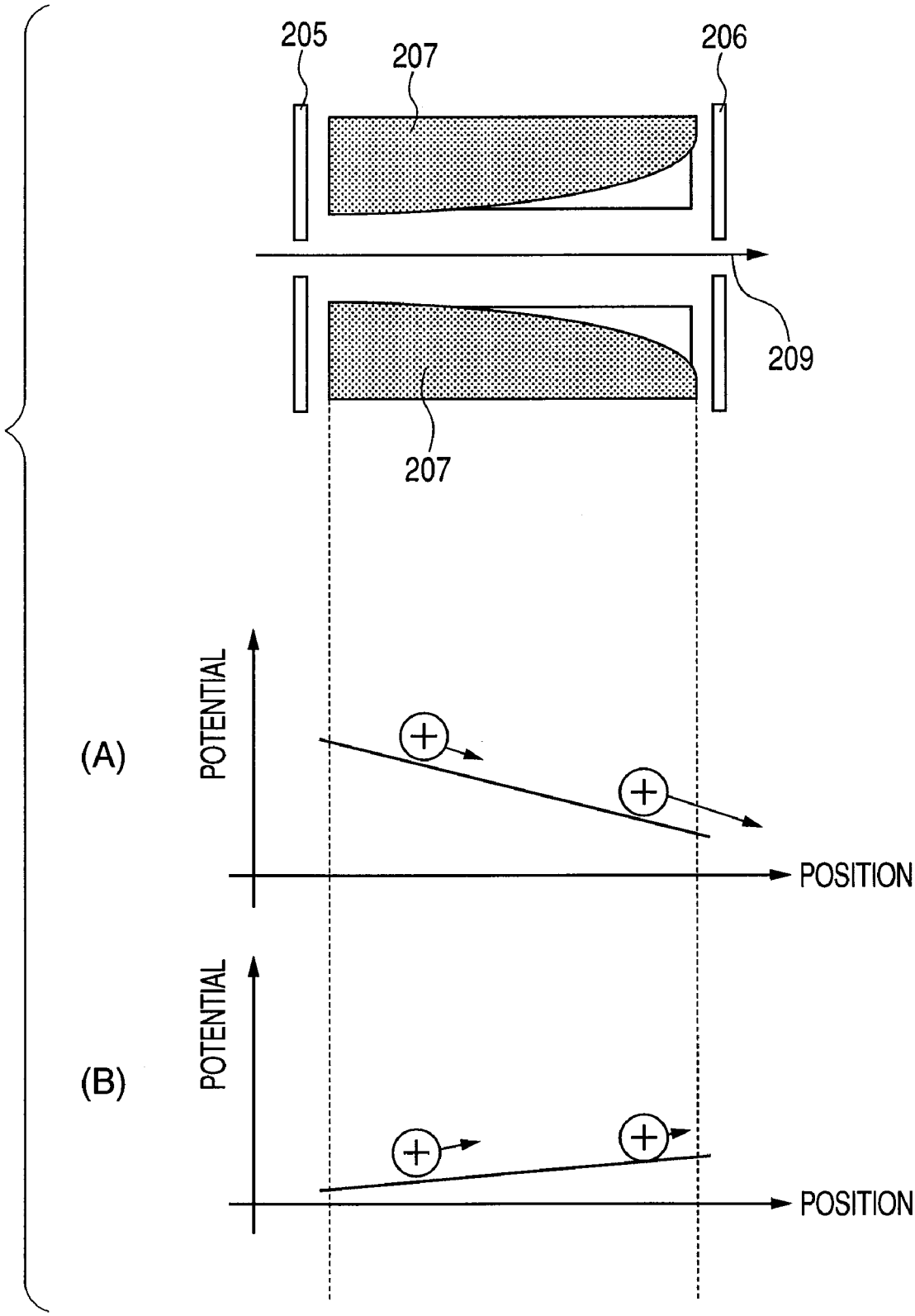
FIGS. 3A and 3B are diagrams of electric potential slopes to be formed on the center axis of the quadrupole electrodes of the collisional-damping chamber shown in FIG. 1.

If a voltage is applied to the curvilinear auxiliary electrodes 207 as shown in FIG. 2 from the DC voltage supply 116, a potential slope is formed on the center axis of the object linear quadrupole electrode of the collisional-damping chamber 108. And if a positive voltage is applied to a curvilinear auxiliary electrodes with the use of the DC voltage supply 116, a right downward potential slope is formed on the center axis as shown in FIG. 3A. The positive ions are thus forced to eject by auxiliary electrodes (to the right in FIGS. 3A and 3B) having a positive voltage, thereby the ejection time of the ions is shortened. Because the inclination of the potential slope is adjusted in accordance with the adjusted voltage of the DC voltage supply 116, the speed of ions can be controlled, that is, the ejection time of ions can be controlled. And if a negative voltage is applied the curvilinear auxiliary electrodes with the use of the DC voltage supply 116, a right upward potential slope is formed on the center axis as shown in FIG. 3B. The positive ions are thus slowed down by auxiliary electrodes (to the left in FIGS. 3A and 3B), thereby the ejection time of the ions is lengthened. In case of the right upward potential slope, ions might be U-turned to the left in FIG. 2 although it depends on the slope size. This causes a loss of ions. In order to avoid this loss of ions, the DC voltage supply 116 requires fine adjustment.

Figure 4:
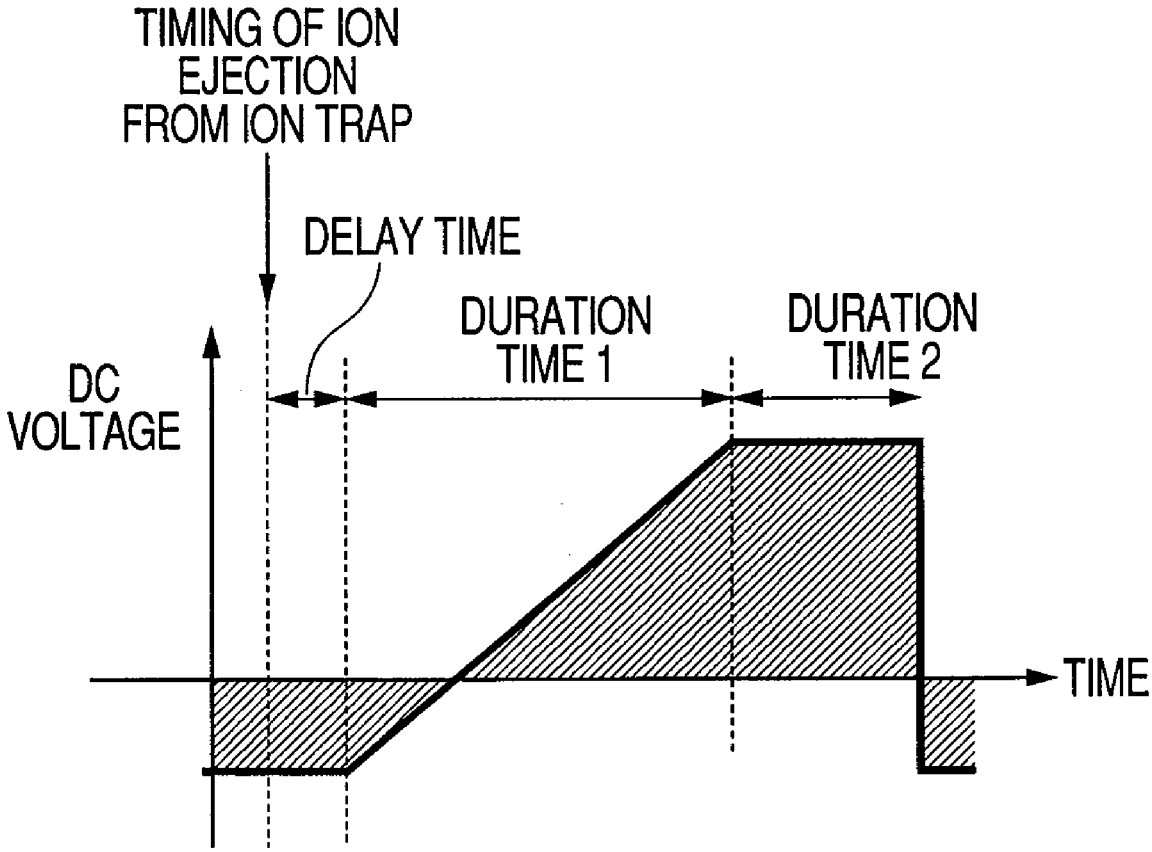
FIG. 4 is a time sequence diagram of the voltage of the DC voltage supply, applied to the auxiliary electrodes.

FIG. 4 shows a diagram of a time sequence of the voltage with the use of the DC voltage supply 116, which is applied to the auxiliary electrodes 207. The voltage output from the DC voltage supply 116 is controlled synchronously with the ion trap. An ejection timing of ions ejected from the ion trap disposed in the preceding stage is delayed by a preset time and a voltage is applied to the object auxiliary electrode 207 at the delayed time. This delay time is required to prevent the loss of ions and to apply the voltage when all the object ions are caught in the collisional-damping chamber. In FIG. 4, a negative voltage is kept applied to the auxiliary electrode 207. And when the ejection timing of ions ejected from the ion trap is delayed by the preset time, the voltage is increased linearly just during the duration time 1, then a positive voltage is applied to the auxiliary electrode 207 just during the duration time 2. The total time of the duration times 1 and 2 is the same as the cycle of the ion trap disposed in the preceding stage. Thus the shorter the duration time is, the shorter the ejection time of ions can be set. A negative voltage is applied to the auxiliary electrode 207 as described above, ions are not ejected immediately from the collisional-damping chamber 108 and stayed therein. After this, the voltage is raised gradually to make it easier to eject ions. The delay time may be 0 and either of the duration times 1 and 2 may be 0. In FIG. 4, a negative voltage is applied initially, then raised up to a positive one linearly. Although it depends on the bias voltage of its neighbor electrodes, the voltage may be changed from positive to positive or from negative to negative in cases. The ejection time controlling method described above is for positive ions. The voltage polarity is inverted to control negative ions.

Figure 5A:
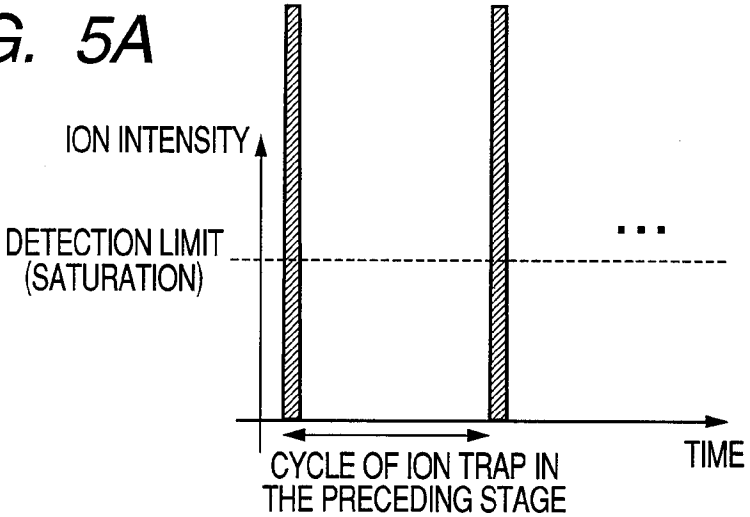
FIGS. 5A, 5B, and 5C are diagrams showing a comparison result of the effect between the conventional technique and the present invention.
Figure 5B:
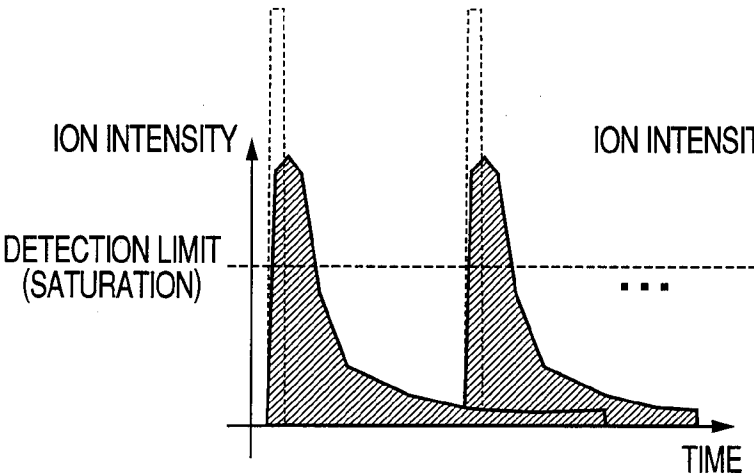
Figure 5C:
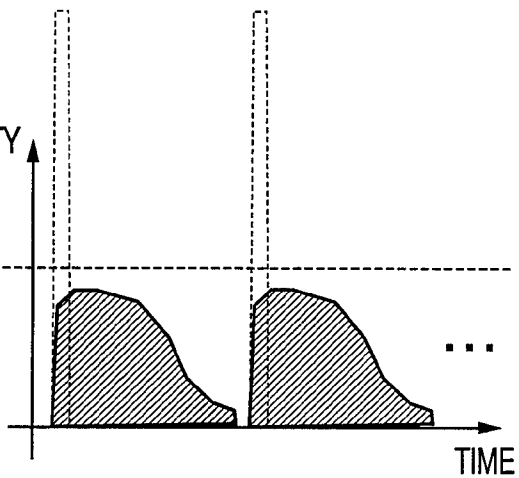

FIGS. 5A to 5C show a difference between the effect of the conventional technique and the effect of the technique of the present invention disclosed in this specification. FIG. 5A shows the time distribution of ions introduced into the collisional-damping chamber 108. As shown in FIG. 5A, ions ejected from the ion trap are distributed like pulses in a very short time range. Therefore, if those ions ejected from the ion trap are detected directly by a detector, many ions beyond the detection limit are not detected. This has been a problem. FIG. 5B shows the time distribution of ions ejected from the collisional-damping chamber disclosed in JP-A-2005-044594 (prior art). Due to this collisional-damping chamber, ions are slightly spread temporally in the distribution. However, there are still some ions that are beyond the detection limit and cannot be detected. Furthermore, some ions have an ejection time longer than the cycle of the ion trap, so that those ions come to be mixed with other ions ejected later. This has also been a problem. FIG. 5C shows the time distribution of ions ejected from the collisional-damping chamber 108 disclosed in this specification. Due to the collisional-damping chamber 108 of the present invention, the ions ejection time can be controlled so that the ions can be ejected so as not exceed the detection limit and not mixed with the ions ejected next.

In order to control the ejection time of ions according to the technique disclosed in this specification, it is required to measure both the amount of ions and the ejection time as shown in FIGS. 5A to 5C. The measurement result is feed back to the DC voltage supply 116 to optimize the ejection time. The amount of ions and the ejection time are measured with use of such detectors 113 and 114 as an MCP, etc. disposed in the succeeding state of the collisional-damping chamber 108. Ions are ejected just by once from the ion trap 105 and introduced into the collisional-damping chamber 108. While this measurement is made, ejection of other ions from the ion trap 105 is suspended. The measuring cycle is 100 us to 10 ms and the measurement result is stored in the data storage/controller 115 of a personal computer or the like. And according to the measurement result, the voltage of the DC voltage supply 116 is changed. The optimal conditions of the ejection time of ions are determined so as to satisfy that the time distribution of ions is lengthened as long as the cycle of the ion trap as shown in FIG. 5C and those ions are not mixed with the ions ejected next and do not exceed the detection limit. If a personal computer or the like is used for those measurements and for controlling the voltage of the DC voltage supply 116, the ejection time of ions can be measured automatically and the voltage can be optimized automatically.

Figure 6A:
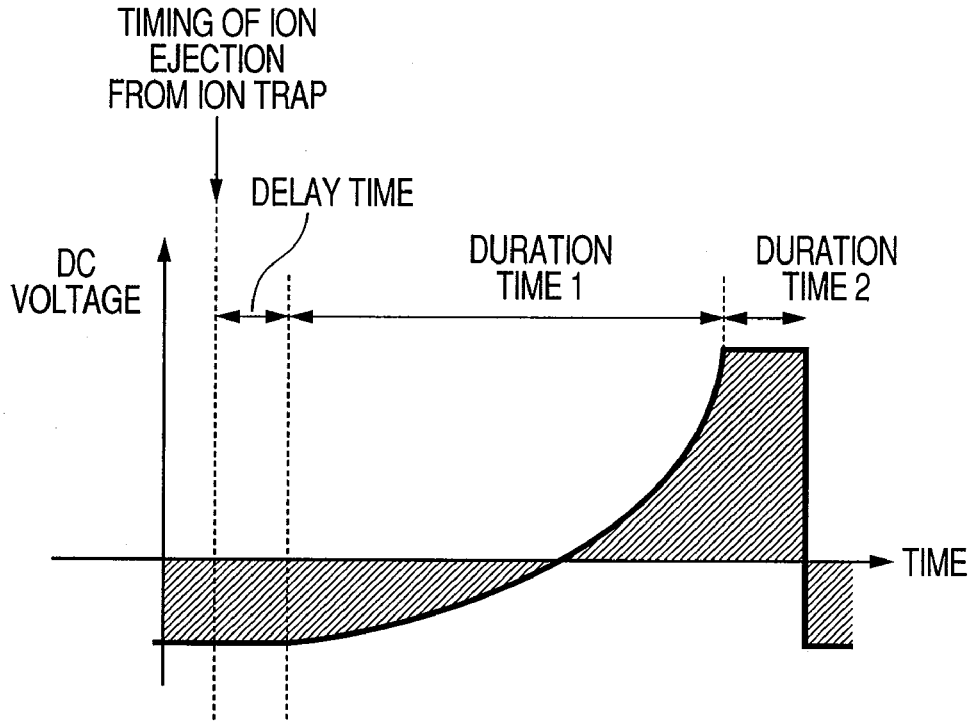
FIGS. 6A and 6B are diagrams showing time sequences of the voltage of the DC voltage supply, applied to the auxiliary electrodes.
Figure 6B:
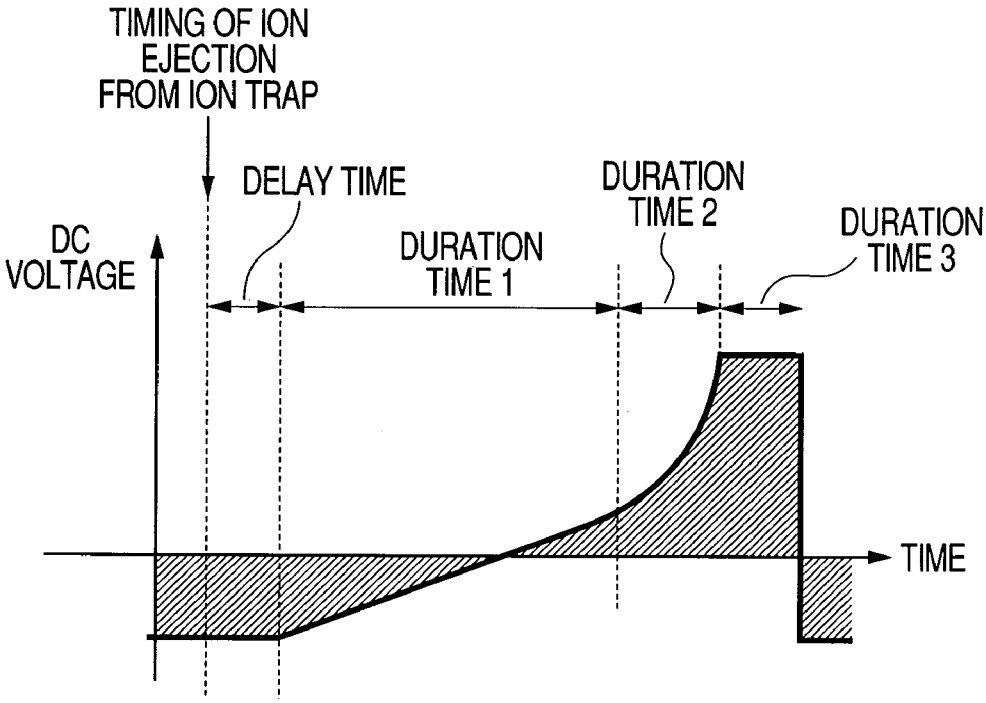

FIGS. 6A and 6B shows another example of the time sequence of the voltage of the DC voltage supply 116, applied to the auxiliary electrodes 207. FIG. 6A shows an example in which a negative voltage is applied constantly to the auxiliary electrodes 207, and then the ejection timing of ions is delayed by a preset time. After this, the voltage is applied to the auxiliary electrodes 207 curvilinearly during the duration time 1. Then, a positive voltage is applied constantly to the auxiliary electrodes 207 during the duration time 2. FIG. 6B shows an example in which a negative voltage is applied constantly to the auxiliary electrodes 207, and then the ejection timing of ions is delayed by a preset time. After this, the voltage is applied linearly during the duration time 1. Then, the voltage is applied to the auxiliary electrodes 207 curvilinear during the duration time 2. Finally, a positive voltage is applied constantly to the auxiliary electrodes 207 during the duration time 3. Those delay times may be 0 and either of the duration times 1 and 2 may be 0. Although a negative voltage is applied initially to the auxiliary electrodes 207 in FIGS. 6A and 6B and the voltage is kept applied until the voltage is raised to a positive one linearly, the voltage might be changed from positive to positive or from negative to negative in some cases due to a bias voltage of its neighbor electrodes. However, because the voltage is changed curvilinearly here, it is prevented to eject a lot of ions at the same time, so that ions are ejected gradually in a distributed manner as shown in FIG. 5C.

Figure 7A:
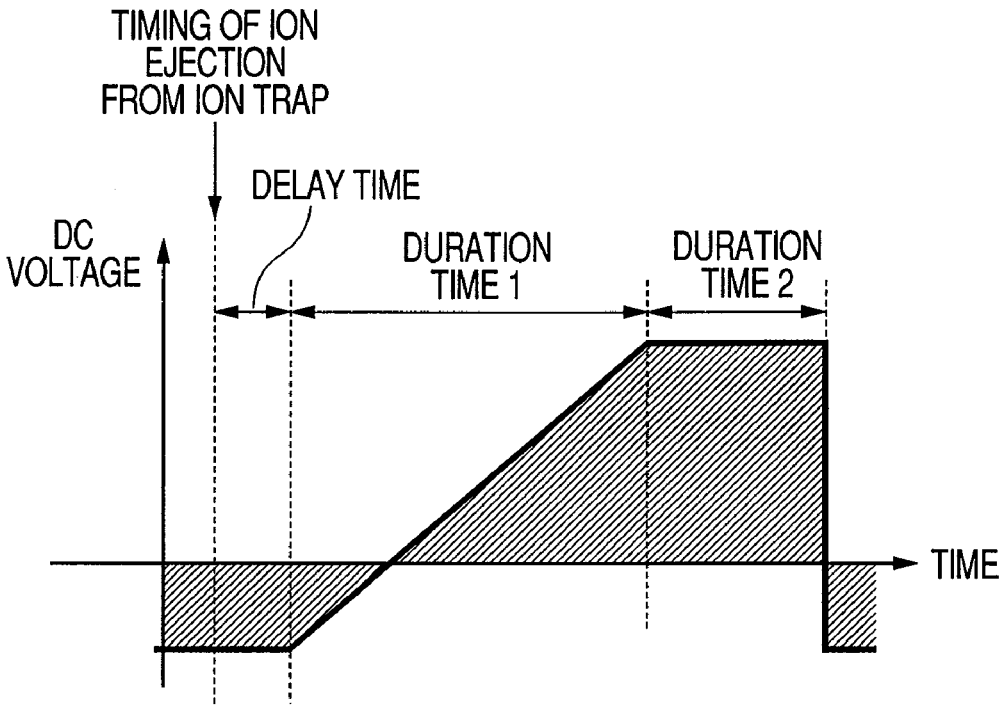
FIGS. 7A and 7B are diagrams showing time sequences of the voltage of the DC voltage supply, applied to the auxiliary electrode and the voltage applied to the end lens electrodes.
Figure 7B:
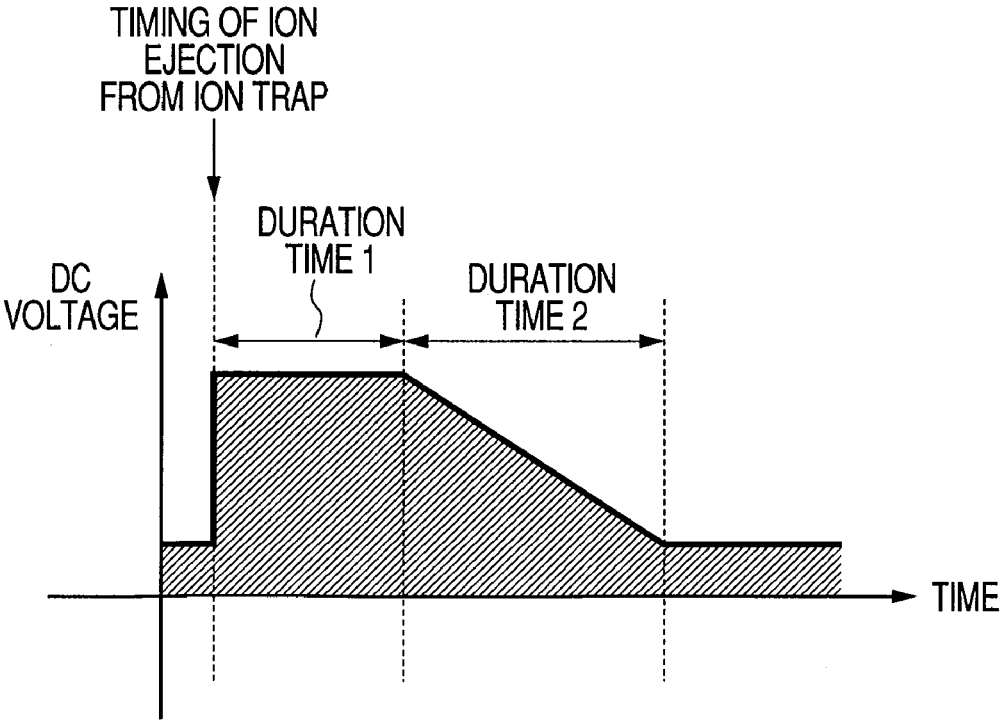

FIGS. 7A and 7B show examples of the time sequence of the voltage of the DC voltage supply 116 that supplies a DC voltage to the auxiliary electrodes 207, as well as the time sequence of the voltage of the end lens electrodes 206. FIG. 7A shows a time sequence of the voltage of the DC voltage supply 116, which is the same as the example shown in FIG. 4. FIG. 7B shows a voltage sequence of the end lens electrodes 206. The end lens electrodes 206 are controlled to prevent quick ejection of ions from the collisional-damping chamber 108. As shown in FIG. 7B, a positive voltage is applied to each of the end lens electrodes 206 constantly at a time of the ion ejected from the ion trap just during the duration time 1. The voltage is controlled so as to reflect ions from the end lens electrodes 206. As a result, ions are not ejected so easily and collectively. After this, the voltage is lowered step by step during the duration time 2 so that ions are ejected slowly and distributed temporally. Thus ejection of ions comes to be measured efficiently. Those delay times may be 0 and either of the duration times may be 0.

Figure 8:
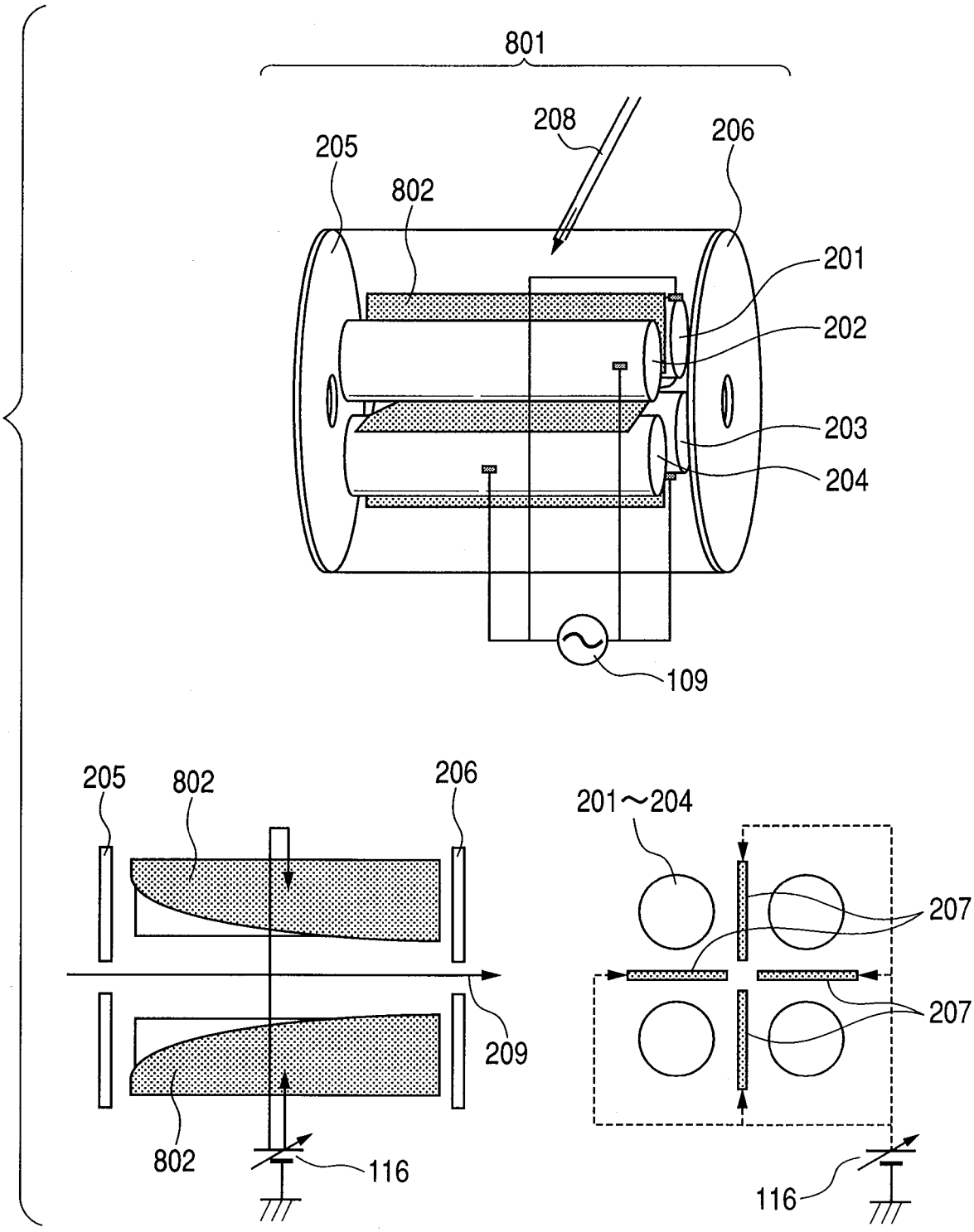
FIG. 8 is a detailed diagram of a collisional-damping chamber.

FIG. 8 shows details of a collisional-damping chamber 701 in another form. In FIG. 8, the shape of the auxiliary electrodes 702 is inverted from that shown in FIG. 2. However, the effect of the auxiliary electrodes is the same as that shown in FIG. 2. In this first embodiment, a negative voltage is applied from the DC voltage supply 116 to the auxiliary electrodes 702 shortens the ejection time of ions while a positive voltage is applied from the DC voltage supply 116 to the auxiliary electrodes 702 lengthens the ejection time of ions. Concretely, a positive voltage is applied to the auxiliary electrodes 702 first, and then the voltage is lowered to a negative voltage step by step, which means that the voltage polarity change pattern is inverted from that shown in FIGS. 3, 5, and 6. Furthermore, in this first embodiment, it is also possible to apply a positive voltage constantly to the auxiliary electrodes 702 to control the ejection time of ions optimally without changing the voltage temporally.

In the examples shown in FIGS. 1, 2, and 8, gases are intentionally introduced into the collisional-damping chamber 108 from the gas inlet 208, the gas introduction, as well as the end lens electrodes 205 and 206 may be omitted. The gas introduction is just required to cool down the ions with use of residual gases in the collisional-damping chamber 108. Therefore, if it is possible to cool down the ions in the collisional-damping chamber 108 without such gas introduction, that is, if the vacuum degree is low and much residual gases are expected in the collisional-damping chamber 108, no gas introduction is required. Furthermore, it is also possible to adjust the amount of those residual gases with use of a vacuum pump and through the holes of the end lens electrodes 205 and 206. The gas to be introduced into the collisional-damping chamber 108 may be a mixed gas, which can also cool down the ions in the dumper 208 similarly to the above case. In other words, only the linear multipole electrodes 201 to 204 and the auxiliary electrodes 207 are required to control the ejection time of ions as described above. The number of auxiliary electrodes 207 may not be four; it is just required to be more than one. And an auxiliary electrode may not be inserted between multipole electrodes respectively; the number of auxiliary electrodes is just required to be more than one. Furthermore, although only one DC voltage supply 116 is used to apply the same voltage to the four auxiliary electrodes in FIG. 2, an independent power supply may be used for each of those four auxiliary electrodes; the voltage may not be the same among those auxiliary electrodes. Although a quadrupole ion trap is disposed in the preceding stage of the collisional-damping chamber 108, the quadrupole ion trap may be replaced with a multipole ion trap or such a device as a matrix-assisted laser desorption ion source that ejects ions like pulses in short cycles. And although a time-of-flight mass spectrometer is disposed in the succeeding stage of the collisional-damping chamber 108, it may be replaced with any detector that can carry out mass analysis; it may be any of a Fourier transform, Fourier transform ion cyclotron resonance, a ion trap, and a quadrupole.

Although the description of the invention and the drawings state that the voltage supply 109 is a radio frequency voltage supply, the voltage supply may also apply a DC voltage to the linear quadrupole electrodes 201 to 204 in addition to the radio frequency. Ions can be moved efficiently by further applying a DC voltage (DC bias voltage). When the ions are positive ions, the voltage is applied to each of the electrodes so that the potential is smoothly declined from the ion source to the detector. The value of the voltage can be decided according to the DC voltage of surrounding electrodes.

Second Embodiment

Figure 9:
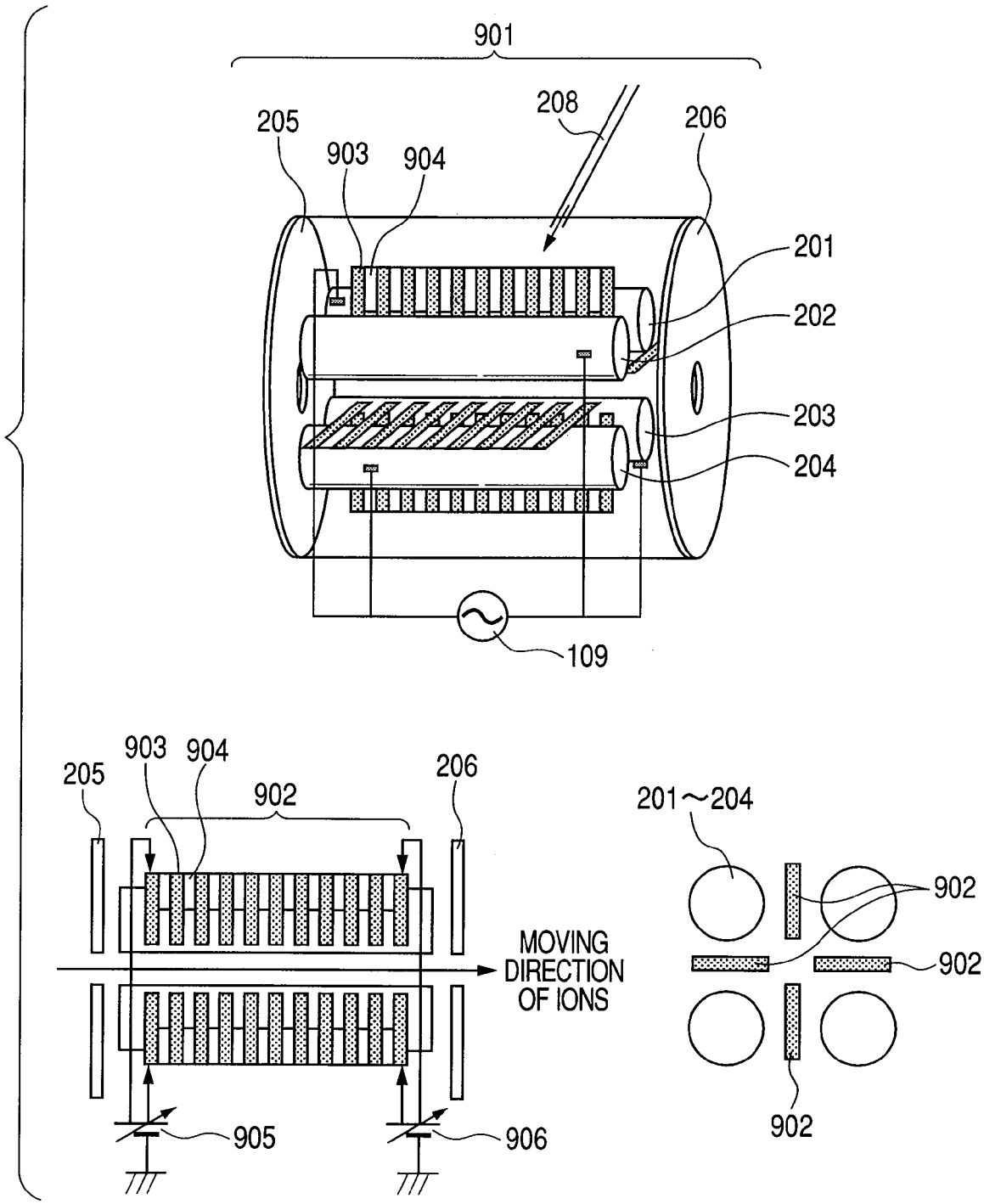
FIG. 9 is another detailed diagram of the collisional-damping chamber.

FIG. 9 shows details of a collisional-damping chamber 901 in still another form. The upper diagram in FIG. 9 shows an external view of another collisional-damping chamber 901 and the lower diagram in FIG. 9 shows a cross sectional view of the collisional-damping chamber 901. The auxiliary electrode 902 of the collisional-damping chamber 901 in this embodiment consists of two parts. One is a metal electrode 903 consisting of a metal conductor that applies an electric field to an object and the other is a resistor or a resistance part 904 having low electrical conductivity and functioning like a resistor electrically. The metal electrode 903 forms a DC potential slope on the center axis of an object quadrupole. The low conductivity resistance part 904 makes a potential difference between both ends of the auxiliary electrode 902. The resistance part 904 is made of a resistor or conductive rubber, an insulator coated with a metal, or the like. Those two parts are connected alternately to the object to form the auxiliary electrode 902. DC voltage supplies 905 and 906 which is different voltage apply a voltage to the auxiliary electrode 902, thereby forming a potential slope on the center axis of the linear quadrupole. For example, if the potential slope is right-downward to shorten the ejection time of ions, it is just required to set the voltage of the DC voltage supply 905 higher than that of the DC voltage supply 906. Other components are the same as those shown in FIG. 2. The effect of the collisional-damping chamber 901 in this second embodiment is the same as that in the first embodiment.

Figure 10A:
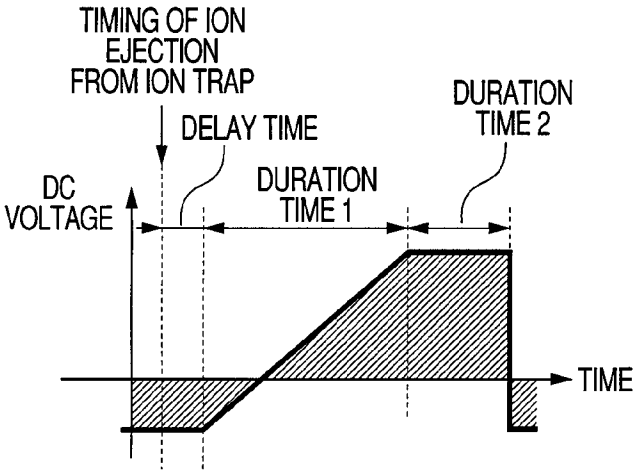
FIGS. 10A, 10B, 10C, and 10D are diagrams showing time sequences of the voltage of the DC voltage supply.
Figure 10B:
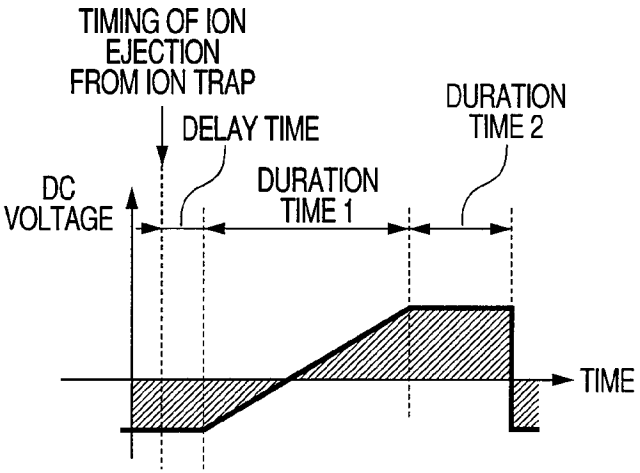
Figure 10C:
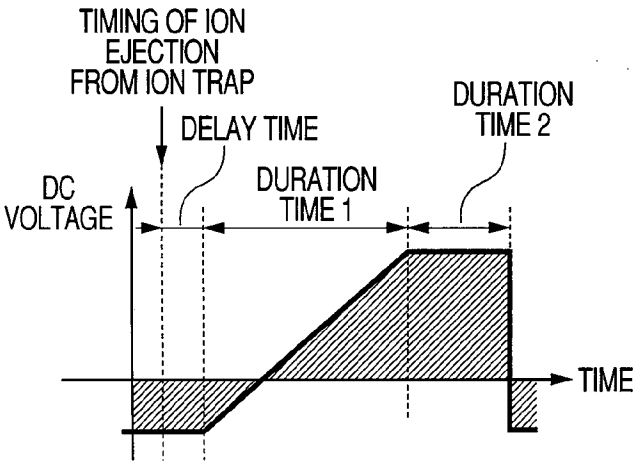
Figure 10D:
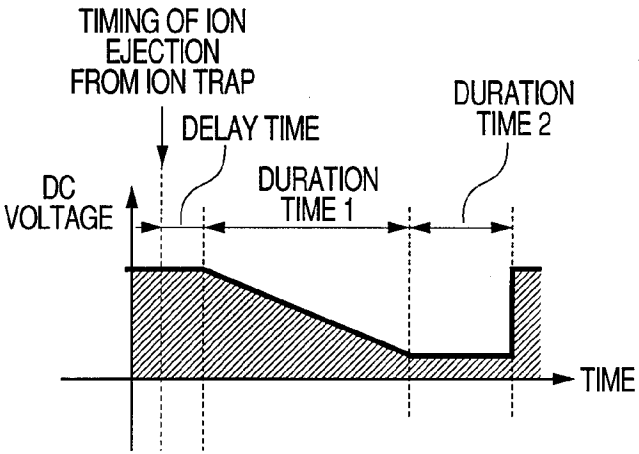

FIGS. 10A to 10D show examples of voltage sequences of each of the DC voltage supplies 905 and 906 shown in FIG. 9. FIGS. 10A and 10B show voltage sequences having the same shape as that shown in FIG. 4 respectively. The voltage sequences of DC voltage supply 905 are shown in FIGS. 10A and 10C, the voltage sequences of DC voltage supply 906 are shown in FIGS. 10B and 10D. FIGS. 10A and 10B shows one example of voltage sequences. When compared with the voltage sequence shown in FIG. 10A, that shown in FIG. 10B has a smaller voltage during the duration time 2. And due to this potential difference between the DC voltage supplies 905 and 906, the potential slope becomes right-downward; thereby the ejection time of ions is shortened. On the other hand, when lengthening the ejection time of ions, it is just required to raise the voltage in FIG. 10B. And if the equal-size metal electrode 903 and the equal-size resistance part 904 are connected to the object alternately, a linear potential slope is formed on the center axis of the object quadrupole. And by increasing the resistance value of the resistance part 904 step by step or by thickening the metal electrode 903 step by step, a curvilinear potential slope can be formed on the center axis of the quadrupole, thereby fine adjustment can be made for the ejection time of ions.

FIGS. 10C and 10D show example of another voltage sequences. If a positive voltage is applied to the auxiliary electrodes 902 at the time of ions ejected from the ion trap and the voltage of the DC voltage supply 906 is set higher than that of the DC voltage supply 905 as shown in FIG. 10D, it is prevented that ions are ejected immediately from the collisional-damping chamber 901. Thus ions are kept staying in the collisional-damping chamber. This method is the same as the method that uses the end lens electrodes 206 described with reference to FIGS. 7A and 7B.

The shapes of the voltage sequences of the DC voltage supplies 905 and 906 shown in FIG. 9 are similar to those shown in FIGS. 3A and 3B. However, the shapes of the voltage sequences may also be curvilinear. Furthermore, the voltage sequences shown in FIGS. 10A and 10B may be combined with the voltage sequence of the end lens electrodes 206 to control the ejection time of ions similarly to that shown in FIGS. 7A and 7B. Even in the example shown in FIGS. 10A to 10D, the delay time may be 0 and either of the duration times 1 and 2 may be 0. Although the initial voltage is a negative one, it may be a positive voltage by taking consideration to the bias voltage of its peripheral electrodes.

The measurement of the ejection time of ions, the voltage feedback to the auxiliary electrodes, and the mass spectrometer examples are the same as those in the first embodiment.

Third Embodiment

Figure 11:
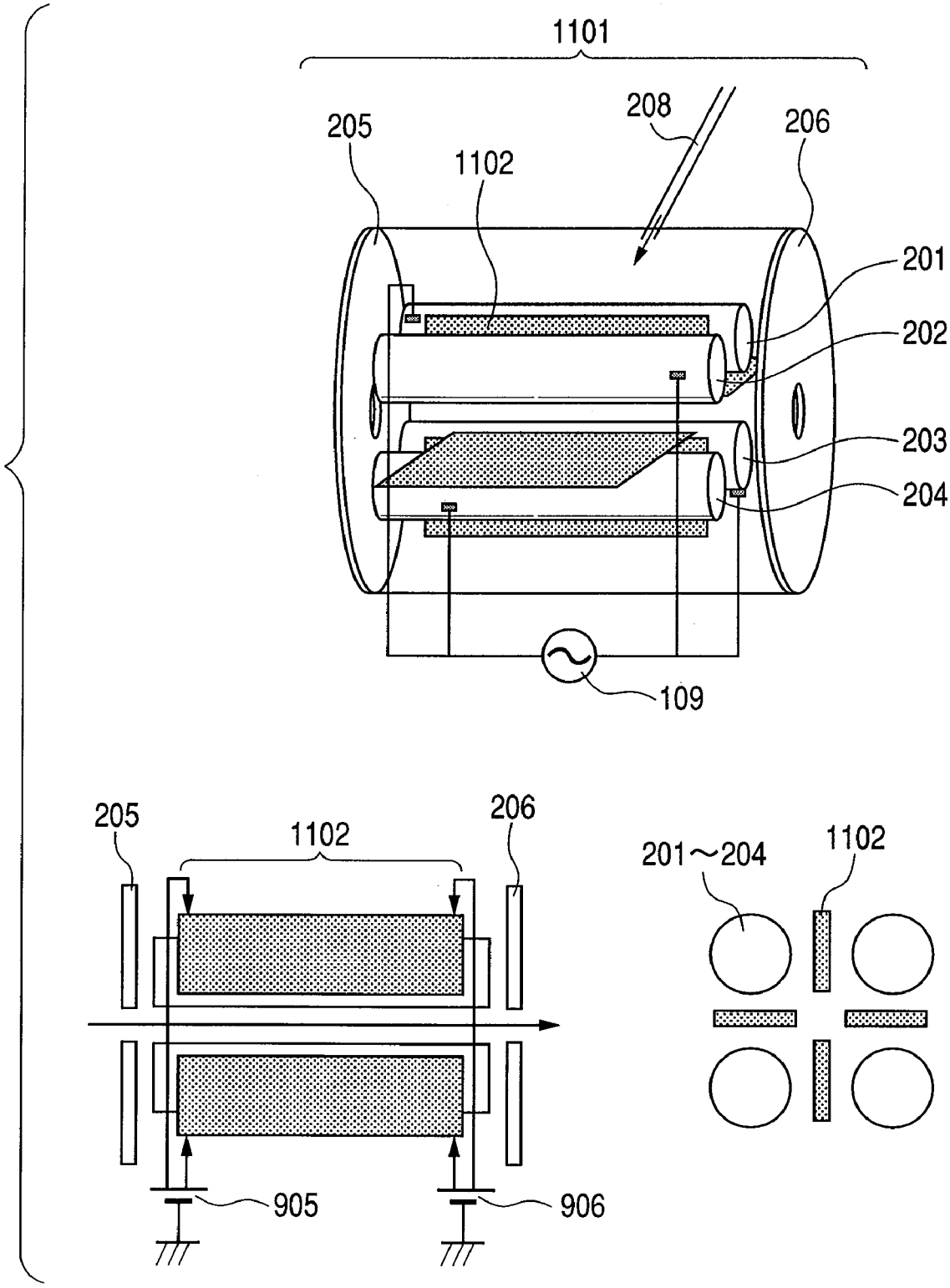
FIG. 11 is still another detailed diagram of the collisional-damping chamber.

FIG. 11 is a detailed diagram of a collisional-damping chamber 1101 in still another form. The upper diagram in FIG. 11 is an external view of another collisional-damping chamber 1101 and the lower diagrams are cross sectional views of the collisional-damping chamber 1101. The configuration of the collisional-damping chamber 1101 in this third embodiment is the same as that shown in FIG. 4 except for the auxiliary electrode 1102. The auxiliary electrode 1102 has electrical properties like a resistance material and a dielectric material disposed between a conductor and an insulator. The auxiliary electrode 1102 is made of a material having lower electric conductivity than that of the conductor. This auxiliary electrode 1102 is used to make a potential difference of several mV to several V between both sides of the object. Consequently, this third embodiment can obtain the same effect as that in the first and second embodiments. Furthermore, the same effect can also be obtained with use of an electrode made of an insulator coated with a resistance material or a conductor coated with a thin film. The voltage sequences of the DC voltage supplies 905 and 906 are the same as those of the second embodiment shown in FIGS. 10A to 10D.

The measurement of the ejection time of ions, the voltage feedback to the auxiliary electrodes, and the mass spectrometer examples are similar to those in the first embodiment.

Fourth Embodiment

Figure 12:
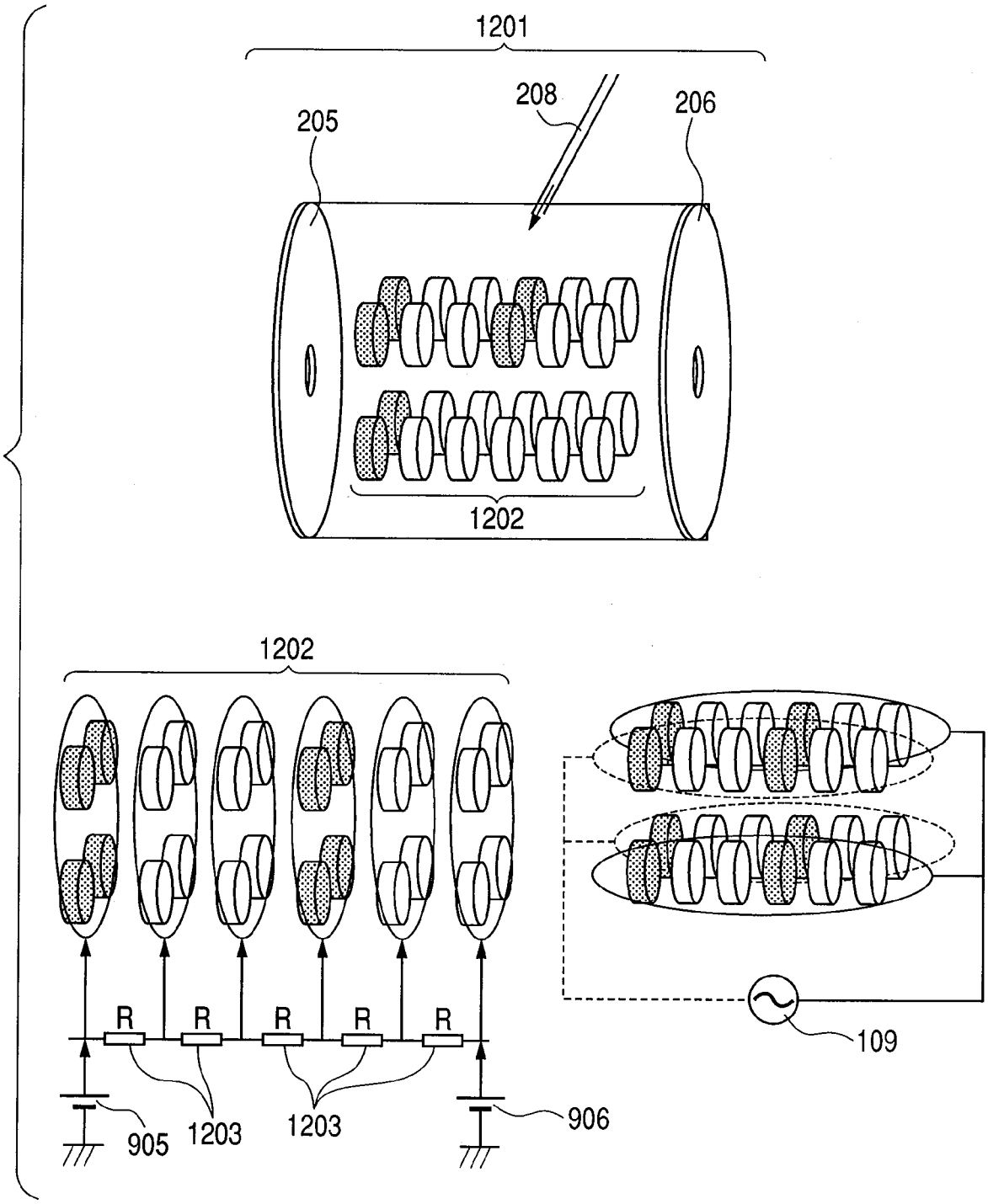
FIG. 12 is still another detailed diagram of the collisional-damping chamber.

FIG. 12 is a detailed diagram of a collisional-damping chamber 1201 in still another form. The upper diagram in FIG. 12 is an external view of another collisional-damping chamber 1201 and the lower diagram in FIG. 12 is a detailed outline drawing of applied voltage. In this fourth embodiment, a lot of quadrupole electrodes are lined up. Concretely, six pairs of quadrupole electrodes 1202 are used in this embodiment. The six pairs of quadrupole electrodes 1202 receives not only a radio frequency voltage, but also a DC voltage obtained by dividing the voltage from the DC voltage supplies 905 and 906 with use of a resistor 1203 respectively as shown in the lower diagram in FIG. 12. As a result, a DC potential is formed on the center axis of the linear quadrupole. The DC potential has a stepped slope. The voltages applied from each of the DC voltage supplies 905 and 906 may be controlled independently with use of 6 different voltage supplies; the voltage is not divided with use of resistors. The voltage sequences of the DC voltage supplies 905 and 906 are similar to those described in the second embodiment and shown in FIGS. 10A to 10D. This configuration just requires changes of the value of the resistor 1203 to adjust the potential slope freely.

The measurement of the ejection time of ions, the voltage feedback to the auxiliary electrodes, and the mass spectrometer examples are the same as those in the first embodiment.

Fifth Embodiment

Figure 13:
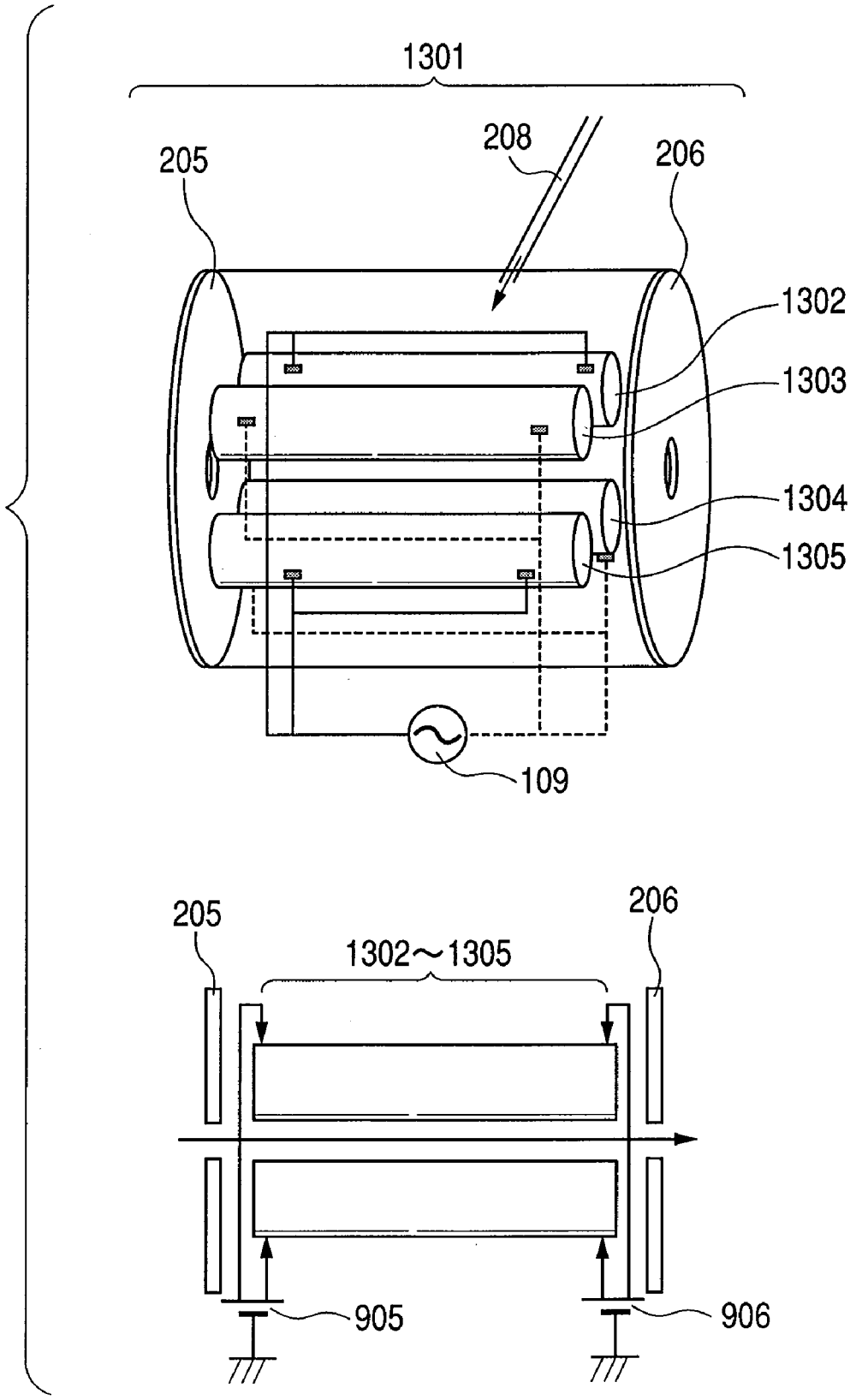
FIG. 13 is still another detailed diagram of the collisional-damping chamber.

FIG. 13 shows a detailed diagram of a collisional-damping chamber 1301 in still another form. The upper diagram in FIG. 13 is an external view of another collisional-damping chamber 1301 and the lower diagram in FIG. 13 is a detailed outline drawing of voltage applied. In this fifth embodiment, the quadrupole electrode is made of a material having low electric conductivity, not made of a conductor such as metal. The quadrupole electrode has electric properties just like those of the resistance material made up of intermediate between those of the conductor and those of the insulator in the third embodiment. The quadrupole electrode is used to make a potential difference of several mV to several V between both sides of the object. Consequently, different voltages can be applied to both sides (right and left ends) of each of the quadrupole electrodes of which electrical conductivity is low from the DC voltage supplies 905 and 906. As a result, a DC potential having a slope is formed on the center axis of the linear quadrupole electrode. The voltage sequences of the DC voltage supplies 905 and 906 are similar to those shown in FIGS. 10A to 10D in the second embodiment. In this case, in order to make the electric field generated by a radio frequency voltage as evenly as possible, the radio frequency voltage should preferably be applied to a lot of places of quadrupole electrode 1302 to 1305.

The measurement of the ejection time of ions, the voltage feedback to the auxiliary electrodes, and the mass spectrometer examples are the same as those in the first embodiment.

As mentioned with respect to FIGS. 1, 2 and 8, with respect to the power supply 109, the power supply 109 shown in FIGS. 9, 11, 12 and 13, which is disclosed as applying a radio frequency voltage, may also additionally apply a DC voltage to the linear quadrupole electrodes.

What is claimed is:

1. A mass spectrometer, comprising:

an ion ejection device that ejects pulsed ions;

a linear multipole unit having means for generating a voltage potential slope along a center axis of the linear multipole unit;

a power supply unit having a first power supply that applies a radio frequency voltage to the linear multipole electrode and a second power supply that applies a DC voltage to the means for generating a voltage potential slope along the center axis of the linear multipole unit;

a controller that controls the second power supply, thereby controlling the voltage potential formed on the center axis of the linear multipole electrode; and a detector that detects ions ejected from the linear multipole unit, wherein the controller controls the second power supply to raise or lower the voltage during ion ejection.

2. The mass spectrometer according to claim 1, wherein the means for generating a voltage potential slope includes a linear multipole electrode and an auxiliary electrode disposed among the linear multipole electrode.

3. The mass spectrometer according to claim 1, wherein the means for generating a voltage potential slope includes a linear multipole electrode and at least one auxiliary electrode disposed among the linear multipole electrode and an end lens electrode disposed at the ion ejection side of the linear multipole unit.

4. The mass spectrometer according to claim 2, wherein one side of the auxiliary electrode corresponding to one side of the linear multipole electrode has a different shape than the other side.

5. The mass spectrometer according to claim 2, wherein the auxiliary electrode is made of plural members having different conductivity and disposed alternately.

6. The mass spectrometer according to claim 2, wherein the auxiliary electrode is a resistive element or a dielectric material.

7. The mass spectrometer according to claim 1, further comprising resistors, wherein the means for generating a voltage potential slope generates the voltage potential slope from a series of linear multipole electrodes in line with the center axis of the linear multipole unit.

8. The mass spectrometer according to claim 1, wherein the means for generating a voltage potential slope generates the voltage potential slope from the linear multipole electrode having a potential difference between both ends of the linear multipole electrode.

9. The mass spectrometer according to claim 1, wherein the second power supply controls the DC voltage to the means for generating a voltage potential slope to raise the DC voltage of the voltage potential slope linearly.

10. The mass spectrometer according to claim 1, wherein the second power supply controls the DC voltage to the means for generating a voltage potential slope to raise the DC voltage of the voltage potential curvilinearly.

11. The mass spectrometer according to claim 1, wherein the second power supply controls the DC voltage to the means for generating a voltage potential slope to fix the DC voltage level in a period of either before or after rising of the DC voltage.

12. The mass spectrometer according to claim 1, further comprising a monitor that monitors the ejection time of ions.

13. The mass spectrometer according to claim 12, further comprising a device that feeds back the monitor result to the means for generating a voltage potential slope; wherein the means for generating a voltage potential slope includes a linear multipole electrode and an auxiliary electrode disposed among the linear multipole electrode.

14. The mass spectrometer according to claim 1, wherein the linear multipole unit comprises 4, 6 or 8 rod electrodes and the first power supply applies a radio frequency voltage to the rod electrodes, alternately.

15. The mass spectrometer according to claim 1, wherein the linear multipole unit includes an end lens electrode.

16. The mass spectrometer according to claim 1, further comprising an ion trap, wherein the linear multipole unit is disposed between the ion trap and the detector.

17. The mass spectrometer according to claim 1, wherein the first power supply additionally applies a DC voltage to the linear multipole electrode.

18. The mass spectrometer according to claim 1, wherein the linear multipole unit includes a plurality of rod electrodes, and wherein the means for generating a voltage potential slope is set between the plurality of rod electrodes.

19. The mass spectrometer according to claim 1, wherein the linear multipole unit has rod electrodes and said means for generating a voltage potential slope generates the potential slope by varying resistance of the rod electrodes along at least a portion of a length of the linear multipole electrodes.

20. The mass spectrometer according to claim 1, wherein the linear multipole unit has a series of linear multipole electrodes and said means for generating a voltage potential slope generates the potential slope by varying an applied voltage to the linear multipole electrodes in a direction along the center axis of the linear multipole unit.

21. A mass spectrometer, comprising:

an ion ejection device ejecting pulsed ions;

a linear multipole unit having a center axis and a plurality of first electrodes and at least one second electrode;

a first power supply applying a radio frequency voltage to the plurality of first electrodes;

a second power supply applying a DC voltage to the at least one second electrode;

a controller controlling the second power supply, thereby controlling the voltage potential formed on the center axis of the linear multipole electrode, and a detector detecting ions ejected from the multipole unit, wherein the controller controls the second power supply to raise or lower the voltage during ion ejection.

22. The mass spectrometer according to claim 21, wherein the first power supply further applies a DC voltage to the plurality of first electrodes.

23. The mass spectrometer according to claim 1, further comprising a monitor that monitors the amount of ejected ions in a time in the succeeding stage of the linear multipole unit, and a feedback device that feeds back the result of the monitoring to the second power supply.

* * * * *